US008403109B2

(12) United States Patent
Bennett

(10) Patent No.: US 8,403,109 B2
(45) Date of Patent: Mar. 26, 2013

(54) TRACKING GATE FOR EXTENDED GANGWAY

(75) Inventor: Ronald W. Bennett, Florence, SC (US)

(73) Assignee: Aluminum Ladder Company, Florence, SC (US)

( * ) Notice: Subject to any disclaimer, the term of this patent is extended or adjusted under 35 U.S.C. 154(b) by 280 days.

(21) Appl. No.: 12/629,501

(22) Filed: Dec. 2, 2009

(65) Prior Publication Data

US 2011/0127111 A1 Jun. 2, 2011

(51) Int. Cl.
*E04G 1/00* (2006.01)
*E04G 3/00* (2006.01)
*E04G 5/00* (2006.01)

(52) U.S. Cl. ..... 182/131; 182/141; 182/113

(58) Field of Classification Search ..... 182/131, 182/62.5, 113, 141
See application file for complete search history.

(56) References Cited

U.S. PATENT DOCUMENTS 487,039 A * 11/1892 Volz ..... 182/141
849,222 A * 4/1907 Fleming ..... 182/62.5
1,708,113 A * 4/1929 Allen ..... 182/62.5
2,896,908 A * 7/1959 Stone ..... 254/1
4,679,657 A 7/1987 Bennett et al.
5,042,612 A 8/1991 Bennett et al.
5,161,700 A * 11/1992 Stannis et al. ..... 211/175
5,167,575 A * 12/1992 MacDonald ..... 454/187
5,368,429 A * 11/1994 Young ..... 414/11
5,392,878 A * 2/1995 Bennett et al. ..... 182/115
6,065,798 A * 5/2000 Sankrithi ..... 296/183.1
6,390,152 B1 5/2002 Donovan et al.
6,405,831 B1 6/2002 Daniel, III
6,923,140 B1 8/2005 Cook
7,004,286 B2 * 2/2006 Fredette ..... 182/62.5
7,140,467 B2 11/2006 Cook
7,216,741 B2 5/2007 MacDonald et al.
8,100,615 B1 * 1/2012 Freeborn ..... 410/130
2004/0047703 A1 * 3/2004 Bernardo ..... 410/132
2007/0125600 A1 6/2007 Bennett et al.

* cited by examiner

*Primary Examiner* — Alvin Chin Shue
(74) *Attorney, Agent, or Firm* — Amy Allen Hinson; Nexsen Pruet, LLC

(57) ABSTRACT

An apparatus for providing safe access to a top of a mobile container. The mobile container has a top, a longitudinal dimension, and a plurality of hatches arrayed along the longitudinal dimension on the top. The apparatus has a raised platform and an extended cage attached to the raised platform wherein the extended cage extends along the longitudinal dimension. A tracking gate, attached to the extended cage, is adapted to vary an effective interior size of the extended cage.

25 Claims, 8 Drawing Sheets

TRACKING GATE FOR EXTENDED GANGWAY

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

FIELD OF THE INVENTION

When loading tanks of transport trucks it is necessary for a workman to open the hatches on the tank prior to loading and to close the hatches after loading. The hatches are typically spaced apart along the top surface of the tank. The top surface of the tank is cylindrical and may be slippery, which presents a hazardous condition for the workman.

If a retractable cage is used to provide fall protection while the workman is addressing each hatch, the cage must be placed over one hatch at a time. This typically means that, after the workman is finished with one hatch, he must exit the cage, raise the cage, move the cage along the length of the tank to the next hatch, lower the cage over the next hatch, and reenter the cage to access the hatch. Alternatively, instead of moving the cage from one hatch to the next, the tank can be moved beneath the cage. Both of these alternatives, however, are time consuming. Thus, a fall protection cage that provides simultaneous access to multiple, and preferably all, hatches on a tank is preferred. A particularly preferred extended fall protection cage is described in commonly owned U.S. patent application Ser. No. 12/574,241 filed Oct. 6, 2009 which is incorporated herein by reference.

A fall protection cage which is large enough to cover multiple hatches has a deficiency in that the length may extend further than the extent of the tank being serviced. This creates a safety problem since the worker may fall into the void between the furthest rearward, or forward, extent of the tank and the cage. There is therefore a need for a tracking gate which can effectively optimize the effective size of the fall protection cage.

SUMMARY OF THE INVENTION

The present invention provides a tracking gate particularly suitable for use with an extended safety cage.

A particular feature of the present invention is the ability to use a fall protection cage which is large enough to accommodate large tankers yet which can be safely implemented for use with smaller tankers or for use with a single hatch.

Other features and advantages, as will be realized, are provided in an apparatus for providing safe access to a top of a mobile container. The mobile container has a top, a longitudinal dimension, and a plurality of hatches arrayed along the longitudinal dimension on the top. The apparatus has a raised platform and an extended cage attached to the raised platform wherein the extended cage extends along the longitudinal dimension with a width in the latitudinal dimension which is perpendicular to the longitudinal dimension. A tracking gate, attached to the extended cage, is adapted to vary an effective interior size of the extended cage.

Yet another embodiment is provided in an apparatus for providing safe access to a top of a mobile container wherein the mobile container has a plurality of hatches arrayed along a longitudinal dimension. The apparatus has a platform and an extended cage attached to the platform wherein the extended cage is capable of moving into and out of engagement with the top of the mobile container. The extended cage is dimensioned to be longer than an area encompassing at least a multiplicity of hatches simultaneously. A tracking gate is positioned within the extended cage and slidably attached to the extended cage wherein the tracking gate moves within the extended cage to limit a user accessible area of the extended cage to be no larger than an area encompassing the multiplicity of hatches, and preferably all of the hatches, simultaneously. A multiplicity of hatches is at least two hatches and preferably all hatches on a tanker.

Yet another embodiment is provided in a method of providing safe access to a mobile container wherein the mobile container has a plurality of hatches arrayed along a longitudinal dimension of a top of the mobile container. The method includes providing a raised platform adjacent to the mobile container; providing an extended cage wherein the extended cage is dimensioned to encompass multiple hatches, and preferably all of the hatches, simultaneously and the extended cage is attached to the platform to be rotated into and out of engagement with the mobile container; providing a tracking gate within the extended cage and slidably attached to the extended cage wherein the tracking gate moves within the extended cage; moving the extended cage into engagement with the mobile container and moving the tracking gate within the extended cage to limit a user accessible area of the extended cage to be no larger than an area encompassing a select multiplicity of hatches simultaneously.

DESCRIPTION OF EMBODIMENTS OF THE INVENTION

The present invention is related to a tracking gate which is particularly suitable for use with extended fall protection cages and, more preferably, with cages which are accessible through gangways or retractable gangways. Although primarily described herein in terms of its use with tank trucks, it will be clear that the present invention can also be used in connection with a variety of other mobile containers, including but not limited to railroad tank cars and shipping containers, to provide safe simultaneous access to multiple hatches, and more preferably all of the hatches, on the top of the container.

Figure 1:
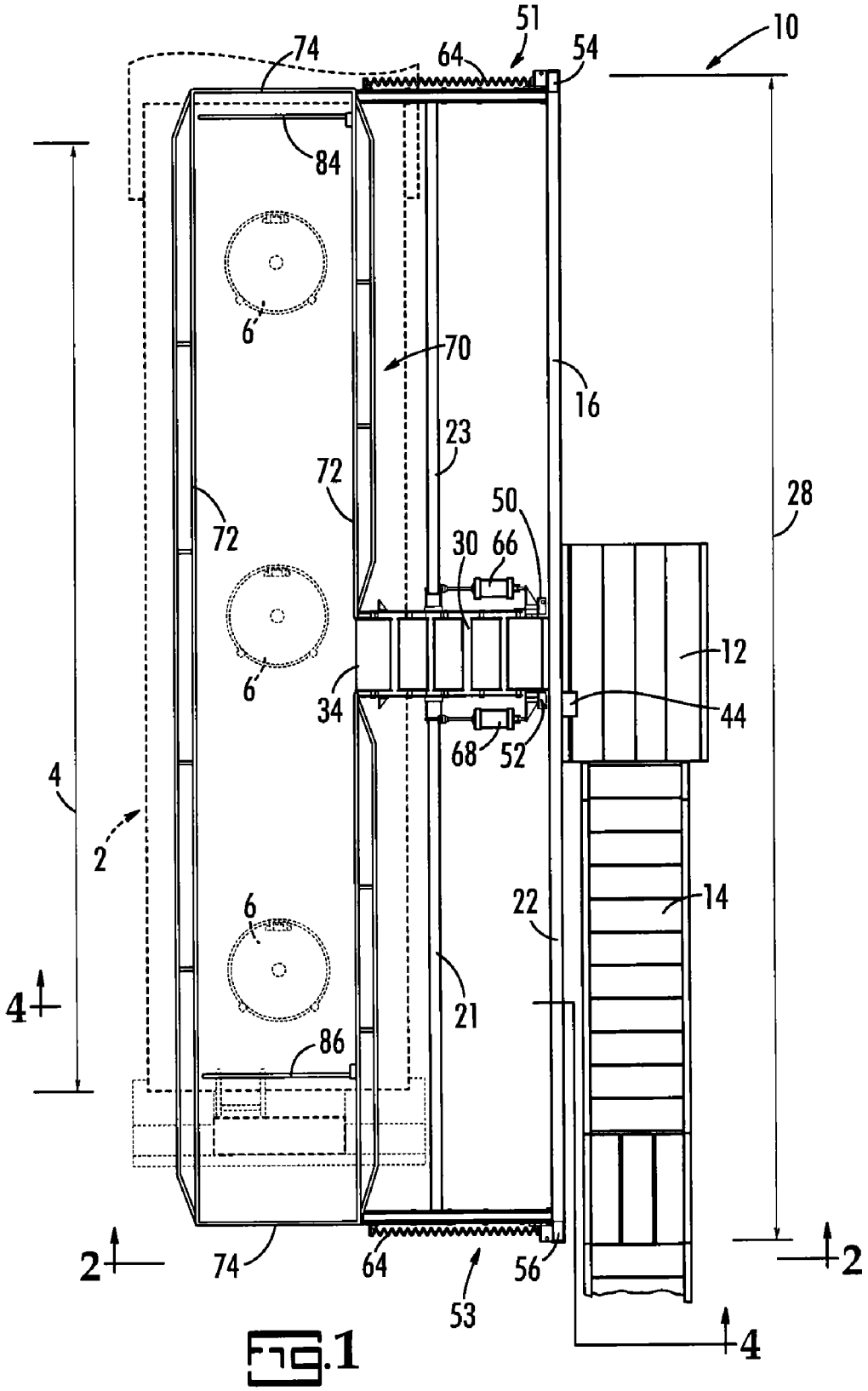
FIG. 1 is a plan view of the extended cage with the retractable gangway in the extended position according to one embodiment of the invention.

FIG. 1 illustrates a plan view of a bulk material tank truck 2 positioned in engagement for servicing at a hatch opening and closing station 10, which preferably includes a raised platform 12, accessible through ladder 14. Tank truck 2 has three hatches 6, through which bulk materials can be added or removed. In order to enhance the safety of workmen who open and close the hatches 6, an extended cage 70 is provided, which is designed to be placed in encompassing relation to the hatches 6 which is referred to as being in engagement. The safety cage 70 is preferably a quadrilateral shaped enclosure generally comprising two long sides 72 and two shorter sides 74 and is preferably accessible through a gangway 30. Gangway 30 is preferably attached at one end to platform 12. The cage 70 is attached at the other, free end 34 of gangway 30, at which point there is preferably a worker access opening in one of the long sides 74 of cage 70.

Figure 2:
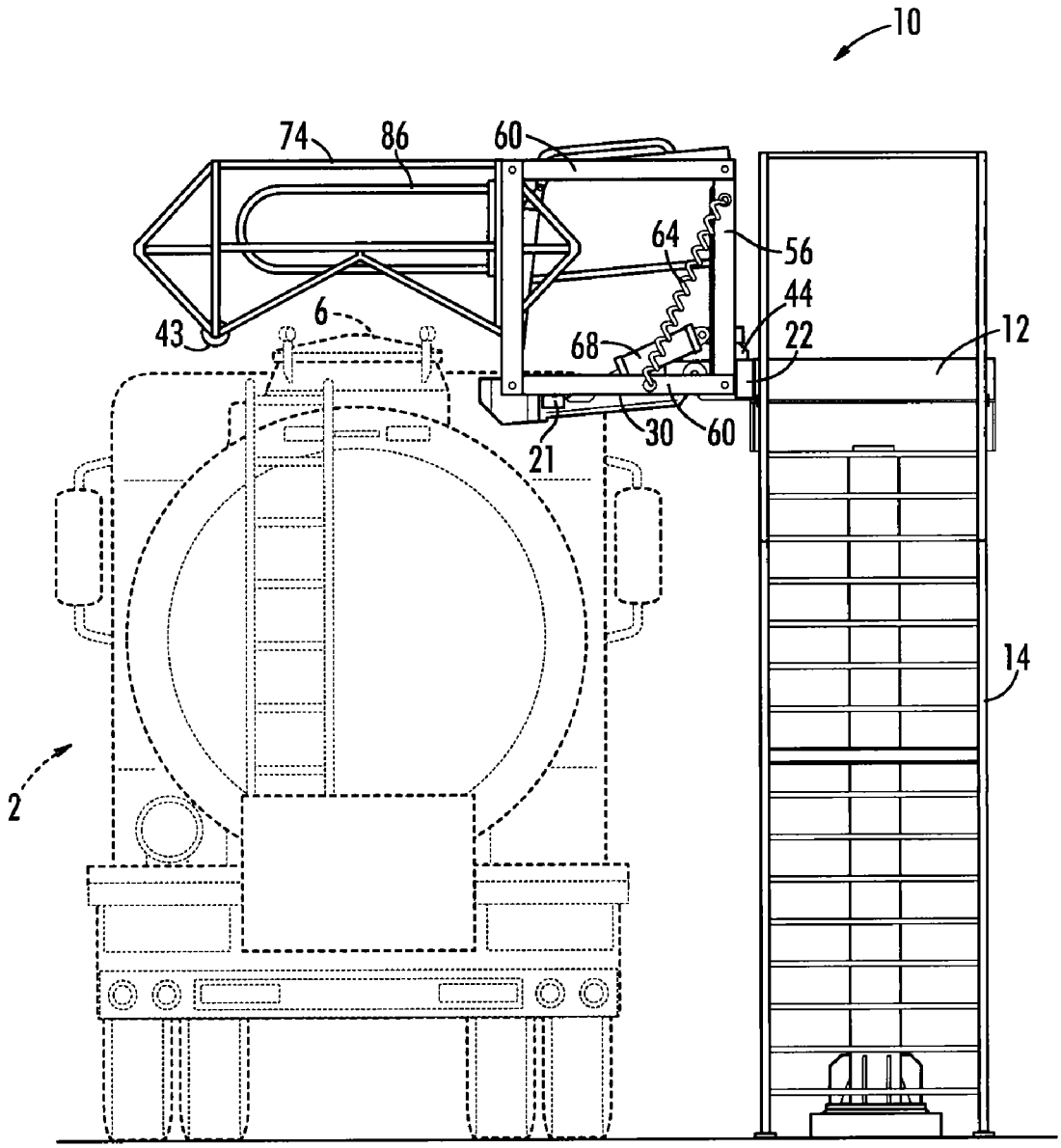
FIG. 2 is a side view of the extended cage and retractable gangway taken at 2-2 in FIG. 1 and showing the gangway in the extended position.
Figure 3:
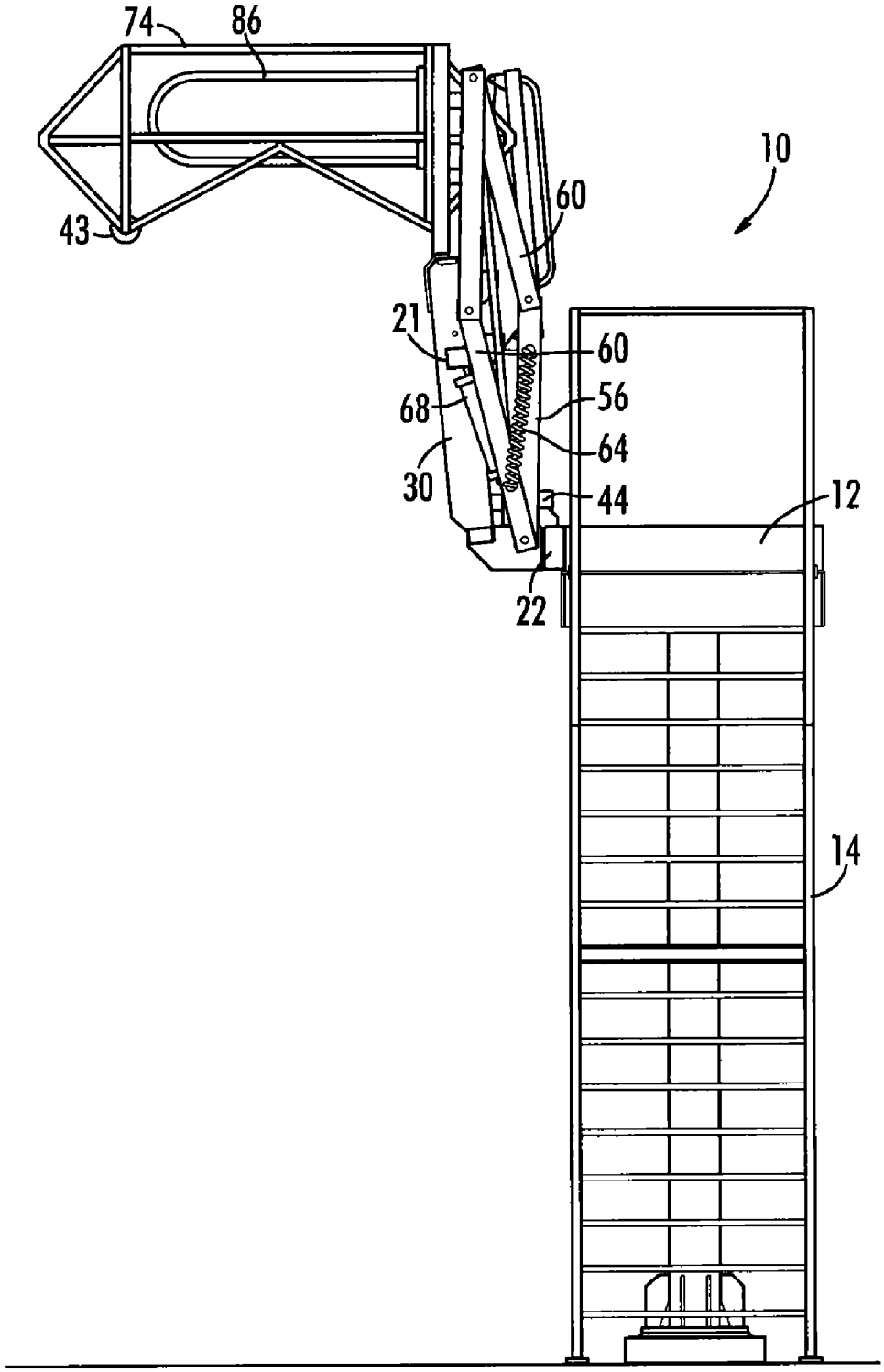
FIG. 3 is a side view of the extended cage and retractable gangway showing the gangway in the retracted position.
Figure 4:
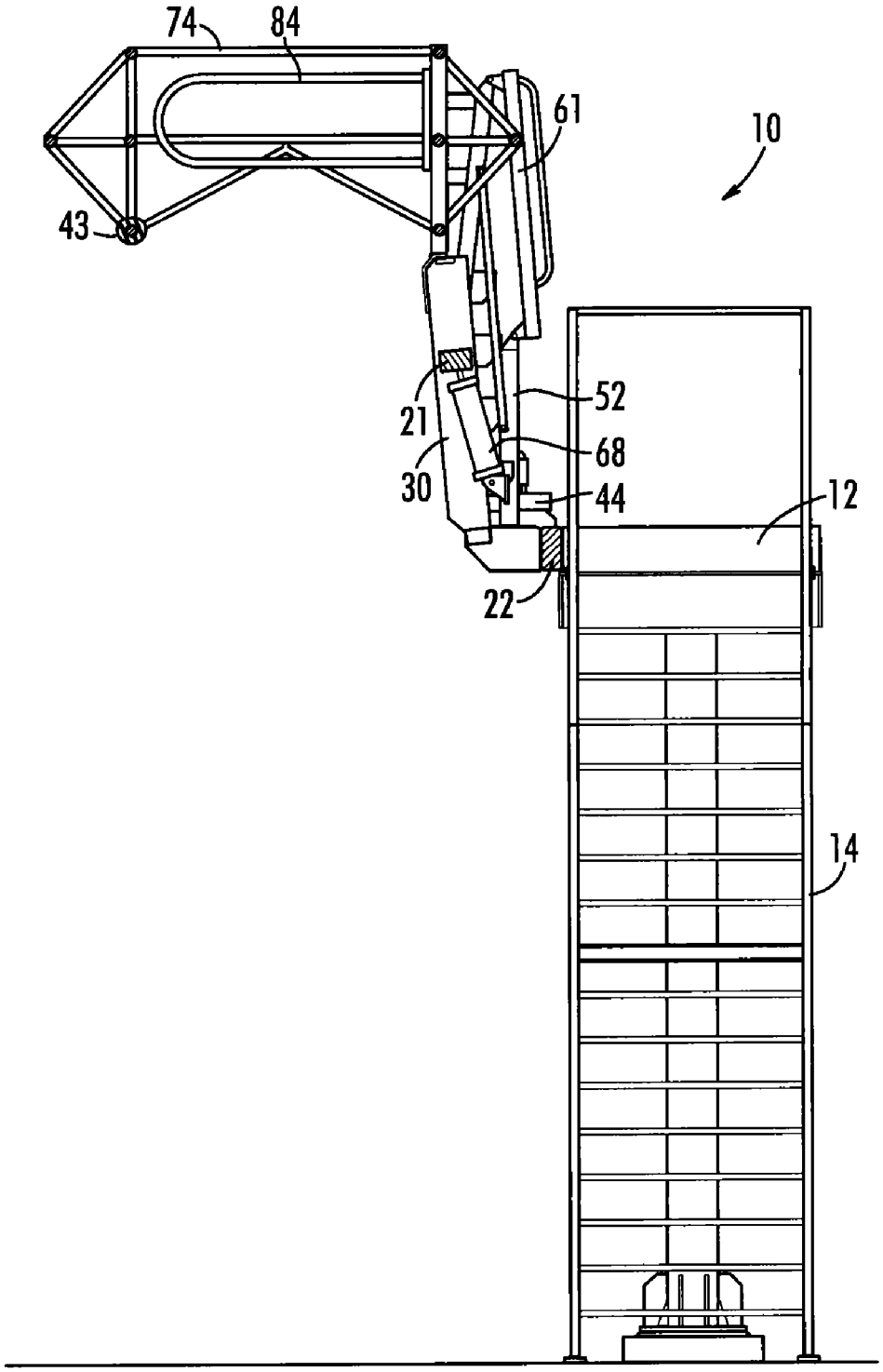
FIG. 4. is a cross-sectional view of the retractable gangway and fall protection cage taken at 4-4 in FIG. 1 and showing the gangway in the retracted position.

The gangway 30 can be in the form of an access stairway having a pair of side rails with self leveling steps therebetween, but can also be a ramp or other walkway mounted between side rails. Gangway 30 is preferably rotatably attached to platform 12 so that free end 34 of gangway 30 can be rotated in a vertical plane from a lowered position (see FIG. 2) to a substantially vertical raised position (see FIG. 3), out of engagement with the mobile container. Note that cage 70 preferably does not rotate when it is retracted but remains level at all times. As shown in FIGS. 2 through 4, the cage 70 can also be outfitted with padding 43 on its lower-most surfaces (see FIGS. 2 and 3) to ensure that cage 70 does not damage or mar the surface of the tank truck 2.

Referring again to FIG. 1, extending in opposing directions from platform 12 and parallel to extended cage 70 are braces 16 and 22. In this particular embodiment, braces 16 and 22 are two halves of a single long brace, but the braces could, alternatively, be two separate pieces, both attached to platform 12. Note that braces 16 and 22 span a length 28 that is substantially as long as or longer than the length 4 of the container of tank truck 2. Note also that braces 16 and 22 are not supported at their distal ends but are cantilevered out from platform 12.

At the distal ends of braces 16 and 22 are outboard uprights 54 and 56 (see FIGS. 1 and 2). Braces 16 and 22 and outboard uprights 54 and 56 may carry lifting arms 51 and 53, respectively. Lifting arms 51 and 53, which are rotatably attached to braces 16 and 22, are comprised of parallel linkages 60 (see FIGS. 2 and 3) and include springs 64 that urge the lifting arms 51 and 53 upward. Lifting arms 51 and 53, in turn, preferably urge cage 70 upward and toward its raised position (as shown in FIG. 3).

There are a number of configurations suitable for using springs 64 in conjunction with parallel linkages 60 to urge one end of the parallel linkages 60 in a certain direction. The configuration shown in the drawings (specifically FIG. 2) is but one of these configurations and other configurations could be employed to demonstrate the invention. All configurations known in the art are intended to be encompassed by the present invention and the description and drawings should not be deemed to narrow the scope of the present invention in any way.

In addition to outboard uprights 54 and 56, inboard uprights 50 and 52 can also be carried by the platform 12, either directly or through braces 16 and 22. The inboard uprights 50 and 52 can serve to support railing 61 (FIG. 4) on gangway 30 as well as optional actuating cylinders 66 and 68. In this particularly preferred embodiment, actuating cylinders 66 and 68 are used to force gangway 30 downward, overcoming the force of springs 64 at lifting arms 51 and 53. Actuating cylinder 66 can be attached between inboard upright 50 and gangway 30 and actuating cylinder 66 can be attached between inboard upright 52 and gangway 30. When the actuating cylinders 66 and 68 are extended, the gangway 30 and cage 70 are pushed downward, toward tank truck 2. When the actuating cylinders 66 and 68 are retracted, the gangway 30 and cage 70, under the urging of springs 64, are permitted to rise toward the upright position (see FIG. 3).

As with springs 64 and parallel linkages 60, there are a number of configurations suitable for using actuating cylinders 66 and 68 in conjunction with the gangway 30 or components attached to the gangway 30 to lower the gangway 30 and cage 70. The configuration shown in the drawings is an exemplary configuration and the present invention is not to be limited to the illustrated configuration. All configurations known in the art are intended to be encompassed by the present invention and the description and drawings should not be deemed to narrow the scope of the present invention in any way as it relates to using actuating cylinders to lower the gangway 30 and cage 70.

Actuating cylinders 66 and 68 can be any type of actuator known in the art, including but not limited to hydraulic actuators or pneumatic actuators. A rotary actuator could also be used. Any actuator capable of urging gangway 30 downward could be used. Furthermore, included is an embodiment that does not use actuators of any kind to lower gangway 30 but simply relies upon the strength or weight of the user to force the gangway 30 downward thereby lowering the cage 70. Accordingly, the extended cage includes an embodiment in which the user, while standing on the platform 12 or by stepping on gangway 30, forces the gangway 30 downward thereby putting cage 70 into the lowered position over tank truck 2.

The extended cage can also include secondary braces 21 and 23, which span between the gangway 30 and the lifting arms 51 and 53, as shown in FIG. 1. Secondary braces 21 and 23 ensure that gangway 30 and the lifting arms 51 and 53 move in unison, keeping the cage 70 level at all times.

The extended cage can also include a lock, including a foot-activated lock 44, which holds the cage 70 in a fixed position until released by a user. Typically, the lock 44 is in communication with the gangway 30 but could, alternatively, be in communication with one or more lifting arms 51 and 53. The lock can be a mechanical lock, an electro-mechanical lock, a hydraulic lock, a pneumatic lock, or any other lock known in the art. Accordingly, the user can, while standing on the platform 12, lower the gangway 30 and cage 70 and then, prior to stepping onto gangway 30, lock the gangway 30 and cage 70 in position to ensure that they do not move while the user is on the gangway 30 or on the tank truck 2. Also, the gangway 30 and cage 70 could be locked in a stowed position as shown in FIG. 3.

The extended cage can also include one or more tracking gates 84 and 86 (see FIGS. 1-3) which will be described more fully herein. Tracking gates 84 and 86 are mobile portions of railing that extend across cage 70 and can be moved along a portion of the length of cage 70. They can thereby be used to vary the effective interior length of cage 70. Note that, in FIG. 1, tracking gate 84 is near one end 74 of cage 70 while tracking gate 86 has been moved away from the other end 74 of cage 70 to prevent a user from falling behind tank truck 2.

Accordingly, tracking gates 84 and 86 can be used to adapt cage 70 for use with tank trucks that are substantially shorter than cage 70, but still have more than one access hatch.

Figure 5:
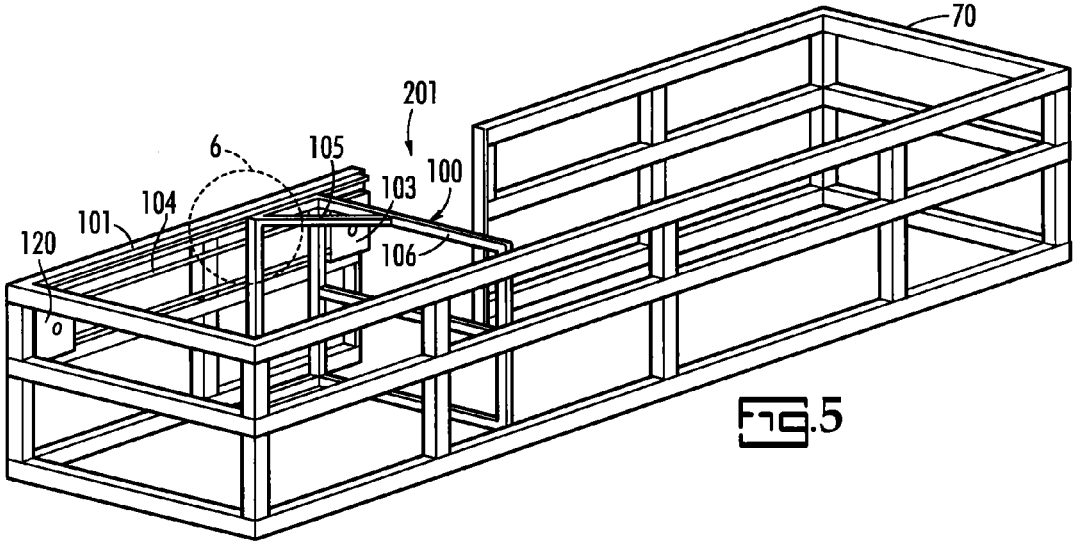
FIG. 5 is a perspective top view of an extended cage in isolation.

Tracking gates will be described with specific reference to FIGS. 5-12. In FIG. 5 an extended safety cage 70 is illustrated in isolated view. The extended safety cage is sufficiently sized to allow simultaneous access to multiple, and preferably all, hatch openings of a tank. At least one tracking gate 100 moves within the extended safety gate to alter the available area within the extended safety gate. The tracking gate is sized to prohibit a worker from walking around the gate within the extended safety cage. In FIG. 5, for example, the tracking gate is positioned to minimize the area to the right of the passage 201 as a worker would enter. The tracking gate could move further right, from the perspective of an entering worker, thereby increasing the area within the extended safety gate. While only one tracking gate is illustrated for clarity a second tracking gate could be on the left side of the passage 201 from the perspective of an entering worker. With two tracking gates the working area could be reduced to be only sufficient to access a single hatch or one, or both, tracking gates could be moved away from the center to allow access to multiple, or all, hatches. The furthest extent of the belt is supported by an idle roller assembly 120.

Figure 6:
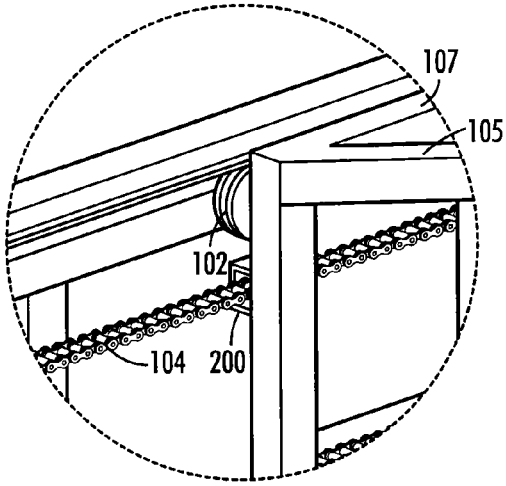
FIG. 6 is a view of the portion of FIG. 5 within circle 6.
Figure 7:
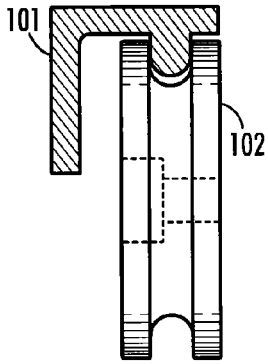
FIG. 7 is a cross-sectional view of a roller and gate track.

With specific reference to FIGS. 5 and 6 the tracking gate comprises a gate barrier 106 which blocks access within the extended safety cage beyond the tracking gate, and a gate carrier 107 which attaches to the carrier mechanism for moving the gate. A brace 105 spanning between the gate carrier and gate barrier is preferred for structural integrity.

With specific reference to FIG. 6 rollers 102, preferably at the top and bottom, are attached to the tracking gate, preferably at the gate carrier. The rollers preferably travel along a gate track 101 preferably bound from sideways migration by engaging protrusions and recesses as exemplified in FIG. 7. A belt attachment element, 200, connects the gate to the belt thereby allowing the gate to move in concert with the belt. The method of contacting the gate to the belt is not particularly limited herein and may be fixed or clutched attachment.

Figure 8:
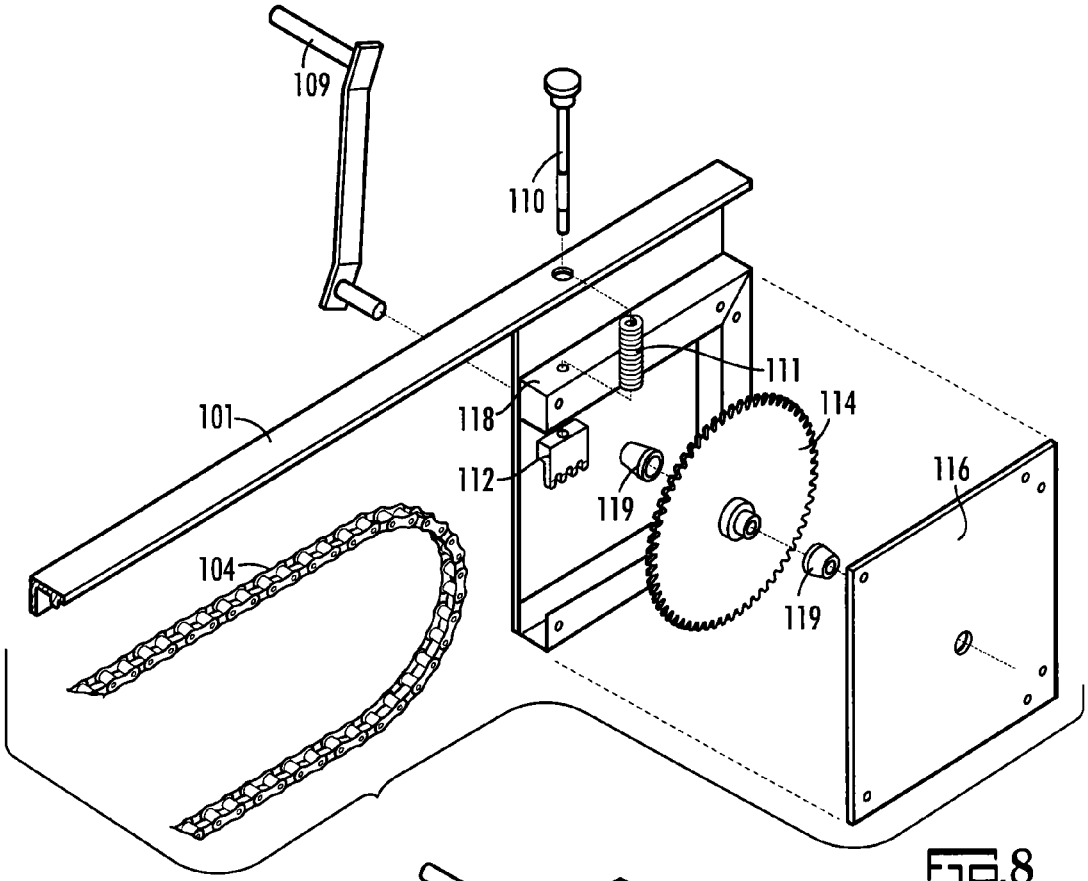
FIG. 8 is an exploded view of the gear enclosure.
Figure 9:
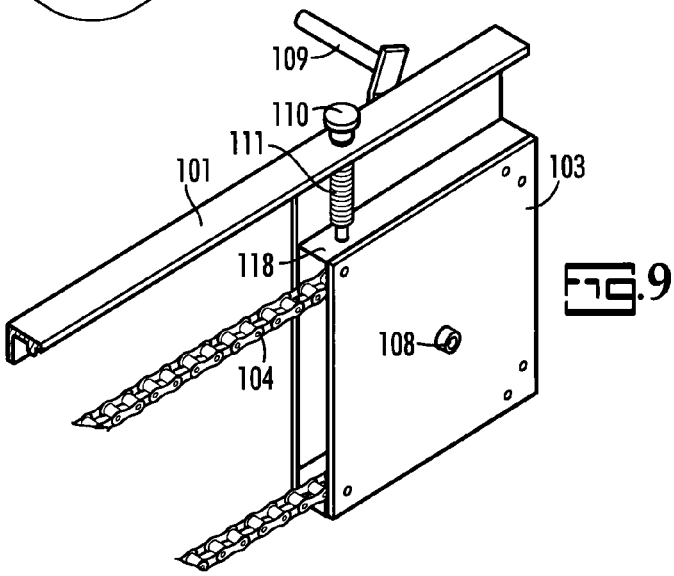
FIG. 9 is a view of a gear enclosure of FIG. 8.
Figure 10:
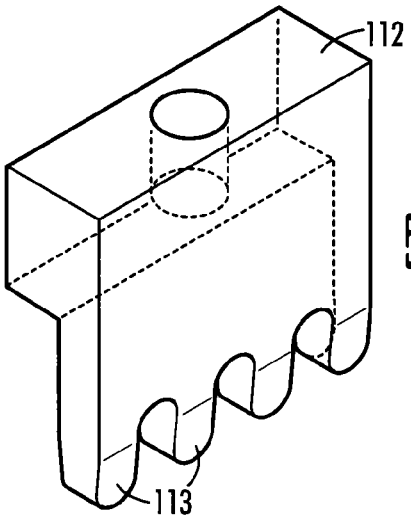
FIG. 10 is a perspective view of a brake of the invention.

A representative gear box assembly 103 is illustrated assembled in FIG. 9 and in exploded view in FIG. 8. The gear box assembly comprises a drive sprocket 114 which is driven by a drive mechanism, 109. The drive mechanism is illustrated as a handle which engages with the drive sprocket. A handle, and particularly a removable handle, is preferred since the handle can be separately secured thereby prohibiting unauthorized use. In another embodiment the drive mechanism may be a motor or similar device with appropriate keys, lockouts and the like for insuring against unauthorized use. The drive sprocket is preferably contained within a cavity defined by a guide block 118 and a cover plate 116. Bushings 119 are preferably included to facilitate smooth rotation of the drive sprocket about its central axis. A belt 104, which is most preferably a roller chain, engages with the drive sprocket, preferably by engaging with drive teeth. As would be realized activation of the drive mechanism causes the drive sprocket to rotate which, in turn, causes the belt to move along the gate track 101 carrying the gate carrier along a path which is substantially parallel to the gate track thereby moving the gate barrier to alter the accessible space within the interior of the extended safety cage.

With further reference to FIGS. 8 and 9 a brake mechanism is provided to guard against inadvertent rotation of the drive sprocket or movement of the chain. A brake 112 engages with either the belt 104 or the drive sprocket 114 to prohibit movement thereof. The brake is preferably attached to a brake handle 110. A spring 111 persuades the brake towards engagement. Withdrawing the brake handle, against the persuasion of the spring, disengages the brake thereby allowing the drive sprocket to rotate and the chain to move in concert with the rotation. In a particularly preferred embodiment, which is more specifically viewed in FIG. 10, the brake 112 comprises brake teeth 113 which protrude into the spaces of a roller chain thereby restricting movement of the roller chain. While not limited thereto it is preferable that the brake be located within the vicinity of the drive roller to minimize disengagement of the brake due to flexing of the belt. Otherwise, it is preferably to provide an idler roller in the vicinity of the brake to prohibit the belt from flexing away from the brake. This is a particular problem with a belt or roller chain that has the ability to stretch over time which may allow it to flex out of linearity between rollers and therefore out of engagement with the brake.

Figure 11:
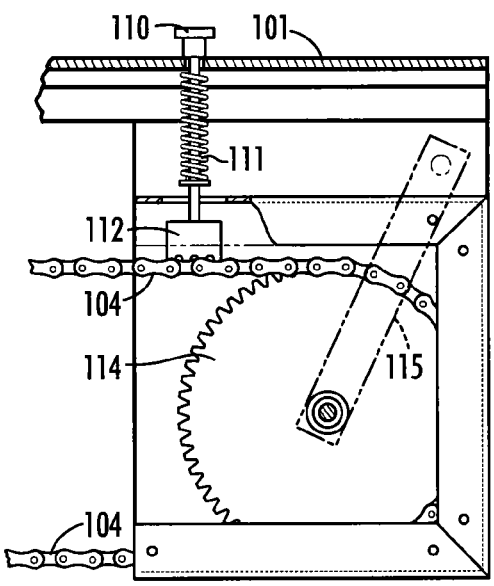
FIG. 11 is a cut-away side view of an embodiment of the invention with the brake engaged.
Figure 12:
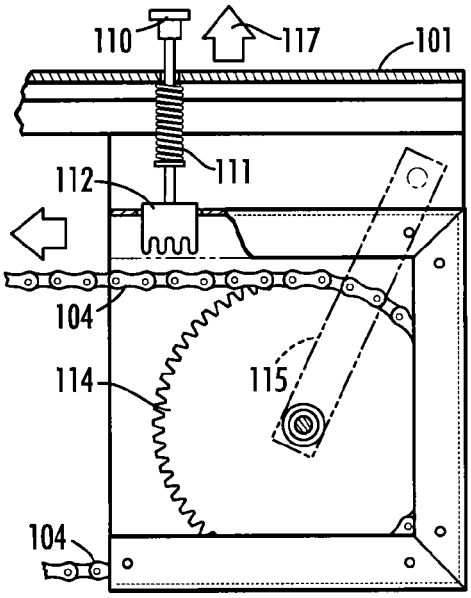
FIG. 12 is a cut-away side view of an embodiment of the invention with the brake disengaged.

The operation of the brake is illustrated, in cut-away view, in FIGS. 11 and 12. In FIG. 11, the brake is engaged with the belt which is illustrated as a roller chain. In FIG. 12 the handle has been withdrawn away from the belt, against the persuasion of the spring, and the brake is disengaged thereby allowing the chain to move in concert with rotation of the drive sprocket. A sprocket brace 115 may be provided to stabilize the drive roller. In a preferred embodiment the sprocket brace comprises a tensioner which persuades the drive roller in a tightening direction relative to the belt.

Figure 13:
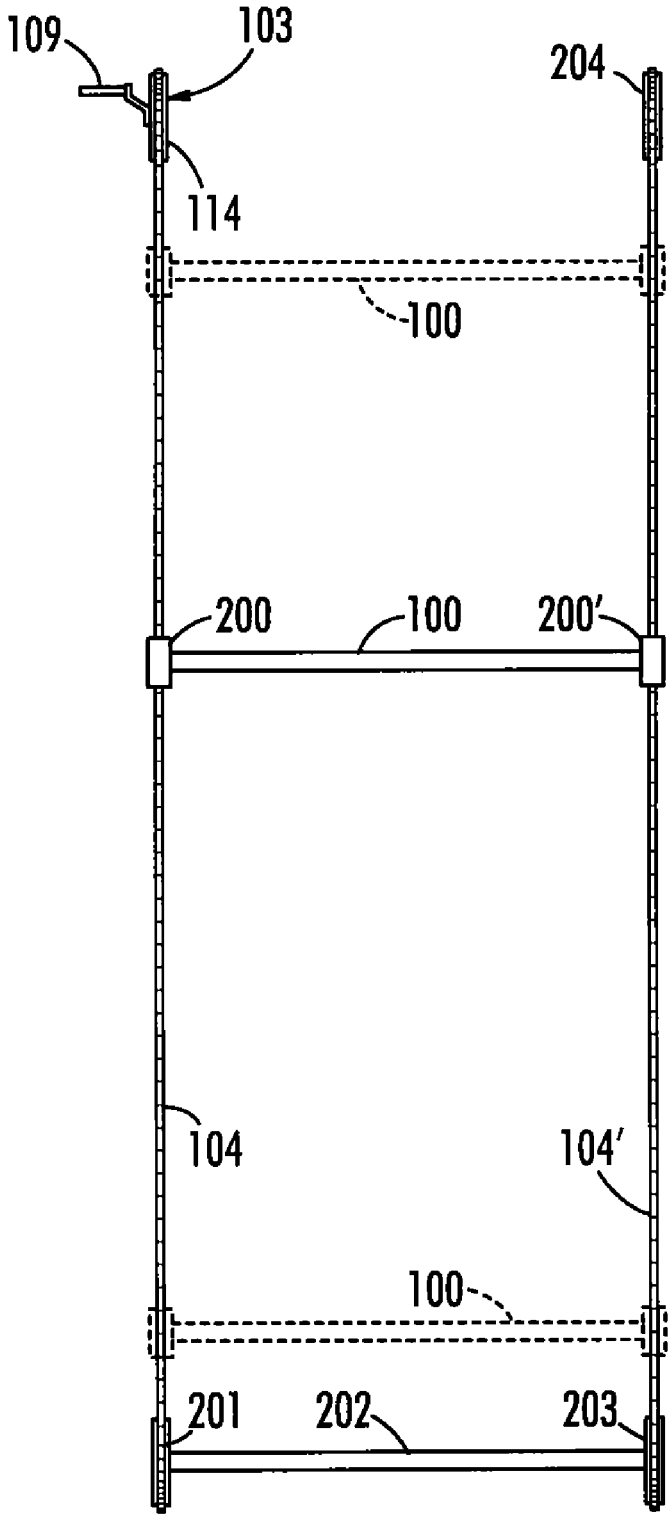
FIG. 13 is a schematic top view of an embodiment of the invention.

An embodiment of the invention is illustrated in FIG. 13. In FIG. 13, the gate 100 is guided along the intended path by a pair of belts, 104 and 104', both of which are preferably chains. In one embodiment it is preferable to have a pair of belts to improve the tracking of the gate. This configuration insures that the gate track correctly and minimizes improper tracking or motions wherein the gate becomes contorted, jammed or otherwise tracks incorrectly. The drive belt 104 drive sprocket 103 drive mechanism 109 and belt attachment element 200 are as described above. A first idle roller 201 is provided at the furthest extent of the belt as would be readily realized by one of skill in the art. A shaft 202 connects the first idle roller 201 to a second idle roller 203. As would be realized the drive sprocket 103 drives the belt which, in turn rotates the first idle roller and second idle roller in concert. A second belt, 104', spans between the second idle roller and a third idle roller 204. The second belt is preferably attached to the gate by a second belt attachment element 200'. The belts, 104 and 104', are preferably chains and the sprockets preferably have teeth which engage with the chain.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. In fact, after reading the above description, it will be apparent to one skilled in the relevant art(s) how to implement the invention in alternative embodiments. Thus, the present invention should not be limited by any of the above described exemplary embodiments.

In addition, it should be understood that the figures, which highlight the functionality and advantages of the present invention, are presented for purposes of example only. The architecture of the present invention is sufficiently flexible and configurable, such that it may be used in ways other than that shown in the accompanying figures.

Further, the purpose of the Abstract of the Disclosure is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The Abstract of the Disclosure is not intended to be limiting as to the scope of the invention in any way.

The invention claimed is:

1. An apparatus for providing safe access to a top of a mobile container, said mobile container having a top, a longitudinal dimension, and a plurality of hatches arrayed along said longitudinal dimension on said top, said apparatus comprising:

a raised platform;

an extended cage attached to said raised platform wherein said extended cage extends along said longitudinal dimension and includes an open bottom for accessing said hatches of said mobile container; and a tracking gate attached to said extended cage at a first location below the upper edge of said extended cage and adapted to vary an effective interior size of said extended cage, said tracking gate is further attached to a belt positioned below said first location and wherein said belt is engaged with a drive socket and rotation of said drive socket causes said tracking gate to move within said extended cage thereby varying said effective interior size of said extended cage, said tracking gate includes a first side and an opposing second side adjacent to said extended cage, wherein said belt is attached to said first side of said tracking gate and said extended cage.

2. The apparatus for providing a safe access to a top of a mobile container of claim 1 wherein said belt is a roller chain.

3. The apparatus for providing a safe access to a top of a mobile container of claim 2 further comprising a brake.

4. The apparatus for providing a safe access to a top of a mobile container of claim 3 wherein said brake comprises at least one tooth which protrudes into a gap of said roller chain.

5. The apparatus for providing a safe access to a top of a mobile container of claim 1 further comprising a drive mechanism for rotating said drive socket.

6. The apparatus for providing a safe access to a top of a mobile container of claim 5 wherein said drive mechanism is a handle.

7. The apparatus for providing a safe access to a top of a mobile container of claim 1 further comprising a gate track.

8. The apparatus for providing a safe access to a top of a mobile container of claim 7 wherein said tracking grate is slidably attached to said gate track.

9. The apparatus for providing a safe access to a top of a mobile container of claim 1 wherein said extended cage is dimensioned to access at least multiple hatches simultaneously.

10. The apparatus for providing a safe access to a top of a mobile container of claim 9 wherein said tracking gate limits mobility of a user beyond said multiple hatches.

11. The apparatus for providing a safe access to a top of a mobile container of claim 1 wherein said tracking gate is contained within said extended cage.

12. The apparatus for providing a safe access to a top of a mobile container of claim 1 wherein said tracking gate moves within said extended cage while varying said effective interior size of said extended cage.

13. An apparatus for providing a safe access to a top of a mobile container wherein said mobile container comprises a plurality of hatches arrayed along a longitudinal dimension of said mobile container wherein said apparatus comprises:

a platform;

an extended cage attached to said platform wherein said extended cage is horizontally disposed from said platform and capable of moving into and out of engagement with a top of said mobile container and wherein said extended cage has a first side and an opposing second side extending along the longitudinal dimension of said mobile container and an open bottom, wherein said extended cage further has a third side and an opposing fourth side extending along the horizontal dimension of said mobile container, said extended cage is dimensioned to be longer than an area encompassing multiple of said hatches simultaneously; and a tracking gate within said extended cage and slidably attached to said extended cage at a first location below the upper edge of said extended cage and along said first side and at a second location along said first side, said tracking gate is further attached to a belt positioned below said first location, said tracking gate extending between said first and second sides wherein said tracking gate moves along said first side and second sides within said extended cage to limit a user accessible area of said extended cage to be no larger than an area encompassing all of said hatches simultaneously while capable of allowing access to all of said hatches within said extended cage simultaneously;

wherein said first side of said extended cage further includes an access opening, said tracking gate capable of sliding from said third side to said access opening of said first side.

14. The apparatus for providing a safe access to a top of a mobile container of claim 13 wherein said tracking gate is attached to a belt wherein said belt is engaged with a drive socket and wherein rotation of said drive socket causes said tracking gate to move within said extended cage thereby varying said effective interior size of said extended cage.

15. The apparatus for providing a safe access to a top of a mobile container of claim 14 wherein said belt is a roller chain.

16. The apparatus for providing a safe access to a top of a mobile container of claim 15 further comprising a brake.

17. The apparatus for providing a safe access to a top of a mobile container of claim 16 wherein said brake comprises at least one tooth which protrudes into a gap of said roller chain.

18. The apparatus for providing a safe access to a top of a mobile container of claim 14 further comprising a drive mechanism for rotating said drive socket.

19. The apparatus for providing a safe access to a top of a mobile container of claim 18 wherein said drive mechanism is a handle.

20. The apparatus for providing a safe access to a top of a mobile container of claim 13 further comprising a brake.

21. The apparatus for providing a safe access to a top of a mobile container of claim 13 wherein said tracking gate limits mobility of a user beyond said multiple hatches.

22. The apparatus for providing a safe access to a top of a mobile container of claim 13 wherein said tracking gate is contained within said extended cage.

23. The apparatus for providing a safe access to a top of a mobile container of claim 13 wherein said tracking gate moves along said first and second sides of said extended cage while limiting a user accessible area of said extended cage.

24. The apparatus for providing a safe access to a top of a mobile container of claim 13 wherein said second location is horizontally displaced adjacent to said first location.

25. An apparatus for providing a safe access to a top of a mobile container wherein said mobile container comprises a plurality of hatches arrayed along a longitudinal dimension of said mobile container wherein said apparatus comprises:

a platform;

an extended cage attached to said platform wherein said extended cage is horizontally disposed from said platform and capable of moving into and out of engagement with a top of said mobile container and wherein said extended cage has a first side and an opposing second side extending along the longitudinal dimension of said mobile container and an open bottom, said extended cage is dimensioned to be longer than an area encompassing multiple of said hatches simultaneously; and a tracking gate within said extended cage and slidably attached to said extended cage at a first location along said first side and at a second location along said first side, wherein said second location is vertically displaced below said first location, said tracking gate extending between said first and second sides wherein said tracking gate moves along said first side and second sides within said extended cage to limit a user accessible area of said extended cage to be no larger than an area encompassing all of said hatches simultaneously while capable of allowing access to all of said hatches within said extended cage simultaneously.

* * * * *